United States Patent [19]

Droho

[11] Patent Number: 5,013,977

[45] Date of Patent: May 7, 1991

[54] IGNITOR FOR HIGH PRESSURE ARC DISCHARGE LAMPS

[75] Inventor: Joseph S. Droho, Chicago, Ill.

[73] Assignee: North American Philips Corporation, New York, N.Y.

[21] Appl. No.: 491,363

[22] Filed: Mar. 9, 1990

[51] Int. Cl.[5] ..... H05B 37/00

[52] U.S. Cl. ..... 315/289; 315/290; 315/209 CD; 315/244; 315/240

[58] Field of Search ..... 315/289, 290, 205, 239, 315/244, DIG. 5, 240

[56] References Cited

U.S. PATENT DOCUMENTS

| | | | |
|---|---|---|---|
| 3,699,385 | 10/1972 | Paget | 315/239 |
| 3,889,152 | 6/1975 | Bodine, Jr. et al. | 315/205 |
| 4,005,336 | 6/1977 | Casella | 315/239 |
| 4,072,878 | 2/1978 | Engel et al. | 315/205 |
| 4,181,872 | 1/1980 | Chermin | 315/240 |
| 4,209,730 | 6/1980 | Pasik | 315/290 |
| 4,275,337 | 6/1981 | Knoble et al. | 315/289 |
| 4,480,214 | 10/1984 | Sodini | 315/290 |
| 4,695,771 | 9/1987 | Hallay | 315/290 |
| 4,876,486 | 10/1989 | Joanino | 315/290 |

FOREIGN PATENT DOCUMENTS

| | | | |
|---|---|---|---|
| 0019481 | 2/1977 | Japan | 315/290 |
| 0046684 | 4/1977 | Japan | 315/289 |
| 0068080 | 5/1979 | Japan | 315/290 |
| 2089596 | 6/1982 | United Kingdom | 315/239 |
| 2095055 | 9/1982 | United Kingdom | 315/239 |

*Primary Examiner*—Eugene R. LaRoche
*Assistant Examiner*—Son Dinh

[57] ABSTRACT

An ignitor or starting circuit for a high pressure arc discharge lamp including a voltage sensitive bidirectional switch and an impedance with a resistor and inductor in series circuit. An additional capacitor is connected in parallel across the voltage sensitive switch and the resistor.

14 Claims, 2 Drawing Sheets

IGNITOR FOR HIGH PRESSURE ARC DISCHARGE LAMPS

This is an invention in the lighting art. More particularly, it involves an improvement in ignitors or starting circuits for high pressure arc discharge lamps.

This invention relates to that disclosed and claimed in U.S. Pat. No. 4,695,771 to Hallay. This application is assigned to the successor-in-interest to the Assignee of Hallay U.S. Pat. No. 4,695,771. All matter contained in Hallay U.S. Pat. No. 4,695,771 is incorporated by reference herein.

It is an object of this invention to simplify ignitor or starting circuits for high pressure arc discharge lamps. This has been accomplished by eliminating one of the components of a prior art starting circuit.

One of the features of the invention is that other components of the starting circuit can be reduced in size.

One advantage of the invention is the reduction in power losses.

In carrying out the invention, there is provided apparatus for igniting and operating a high pressure discharge lamp. The apparatus includes a pair of input terminals for connection to a source of low frequency AC supply voltage. A pair of output terminals is provided for connection to the electrodes of the high pressure discharge lamp. The apparatus also includes an inductance means including a transformer having a winding coupled to at least one of the output terminals. There is also provided a first capacitor and an impedance means including a resistor and an inductor in a first series circuit. The first capacitor and the impedance means are connected in a second series circuit. The second series circuit is coupled to the input terminals by way of a part of the inductance means. A voltage sensitive switching element is coupled to the first capacitor and to the transformer and is operable to at least partly discharge the first capacitor when the voltage across the first capacitor equals a predetermined breakdown voltage of the switching element. A second capacitor is connected in parallel across the voltage sensitive switching element and said resistor by being connected to the junction of the voltage sensitive switching means and said transformer and the junction between said resistor and said inductor.

Other objects, features and advantages of the invention will be apparent from the following description and appended claims when considered in conjunction with the accompanying drawing in which:

Figure 1:
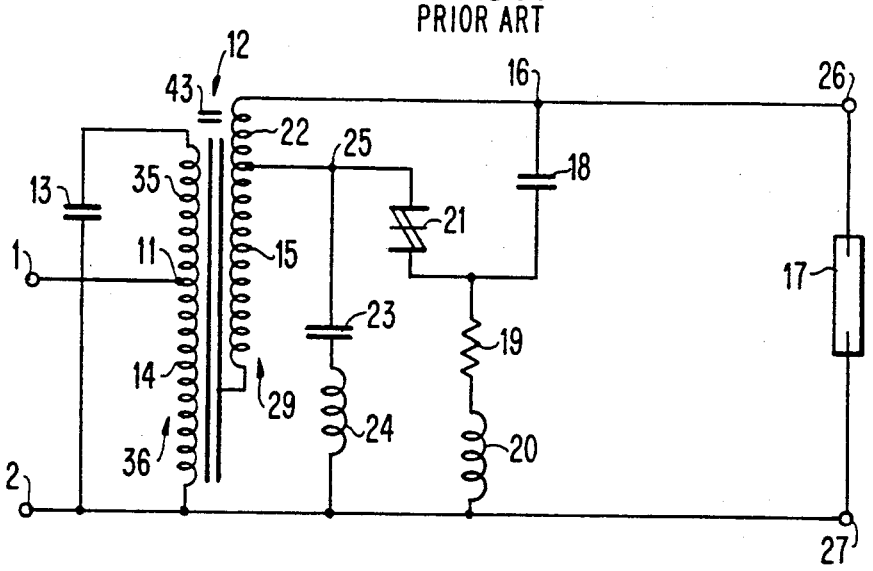
FIG. 1 PRIOR ART
FIG. 1 is a schematic circuit diagram of a prior art starting circuit.

In FIG. 1 there is shown a pair of input terminals, 1 and 2, for connection to a source of low frequency AC supply voltage, for example, 120 volts at a frequency of 60 Hz. Input terminal 1 is connected to a tap point 11 on a high reactance ballast autotransformer 12 comprising windings 35, 36, 29 and magnetic shunt 43. Winding 35 of autotransformer 12 has a top end terminal connected to one terminal of power factor correction capacitor 13. The other terminal of capacitor 13 is connected to input terminal 2.

Tap point 14 on the primary winding of autotransformer 12 is connected to one end of secondary winding 29 of the autotransformer. Windings 15 and 22 together form a pulse autotransformer in the secondary of autotransformer 12 for generating a high voltage ignition pulse for high pressure discharge lamp 17. Windings 35, 36, 15 and 22 are magnetically coupled to one another. End 16 of secondary 29 is connected to one electrode of high pressure gas discharge lamp 17 by way of an output terminal 26. The other electrode of discharge lamp 17 is connected to input terminal 2 by way of output terminal 27.

Starting capacitor 18 is connected in series with resistor 19 and first inductor 20 between end 16 of secondary winding 29 and input terminal 2. Normally open voltage sensitive semiconductor switch 21 having a predetermined breakover voltage is connected across the series connection comprising leg 22 of secondary 29 and ignition capacitor 18. Switching device 21 may be a bilateral switch such as a sidac having a threshold voltage suitable for starting lamp 17. Other devices suitable for the operation of lamp 17 may also be used.

In accordance with Hallay U.S. Pat. No. 4,695,771, capacitor 23 and inductor 24 are connected in a second series circuit between junction point 25 at one terminal of switch 21 and input terminal 2. Capacitor 23 effectively augments the open circuit voltage of the lamp so as to reduce the voltage dip after capacitor 18 discharges by way of switch 21 and leg 22 of secondary 29 to generate the high voltage ignition pulse for discharge lamp 17. Capacitor 23 maintains the lamp voltage at a relatively high level during the discharge of ignition capacitor 18. Inductor 24 prevents a short circuit of the high frequency ignition pulse generated in secondary 29 during the discharge of capacitor 18.

As explained in Hallay U.S. Pat. No. 4,695,771, when input terminals 1 and 2 are connected to a source of AC supply voltage, capacitor 18 is charged by way of windings 15 and 22 of secondary winding 29 and the series circuit comprising resistor 19 and inductor 20. At the same time, capacitor 23 is charged by way of leg 15 and inductor 24. When the voltage across capacitor 18 reaches the breakover voltage of bilateral switch 21, the capacitor discharges by way of switch 21 and leg 22 of secondary 29. By step-up autotransformer action, a high voltage is generated across secondary 29. This high voltage pulse is transferred to the terminals of lamp 17 by way of stray capacitance (not shown) between leg 15 and terminal 2. The stray capacitance provides a low impedance pass for high frequency components of the generated pulse voltage. At the same time, capacitor 23 clamps the power frequency voltage at the lamp terminals to a sufficiently high voltage level to ensure reliable ignition of the lamp.

Once the lamp is in operation, the voltage across its terminals drops to the arc voltage of the lamp. This clamps the voltage across capacitor 18 to a level below the threshold voltage of switching device 21 thereby inhibiting the generation of any high voltage pulses during normal lamp operation.

Figure 2:
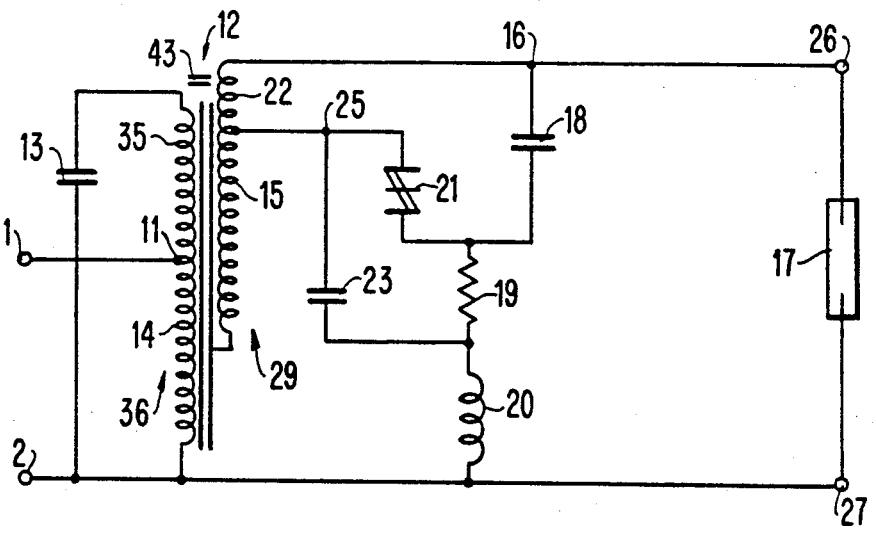
FIG. 2 is a schematic circuit diagram illustrating the invention disclosed herein.

The improvement provided by this invention is shown in FIG. 2. In comparing FIG. 2 with FIG. 1, it will be seen that inductor 24 of FIG. 1 has been omitted from the circuitry of FIG. 2. In the arrangement of FIG. 2, capacitor 23 is connected in parallel across voltage sensitive semiconductor switch 21 and resistor 19. By the elimination of inductor 24, it has been found that the level of inductance of inductor 20 can be reduced and that the capacitance of capacitors 18 and 23 can also be reduced. The reduction of capacitance enables the resistance of resistor 19 to be increased with a consequent reduction of current through resistor 19. As will be understood, this decreases power loss in the circuit as compared to that of FIG. 1.

Figure 3:
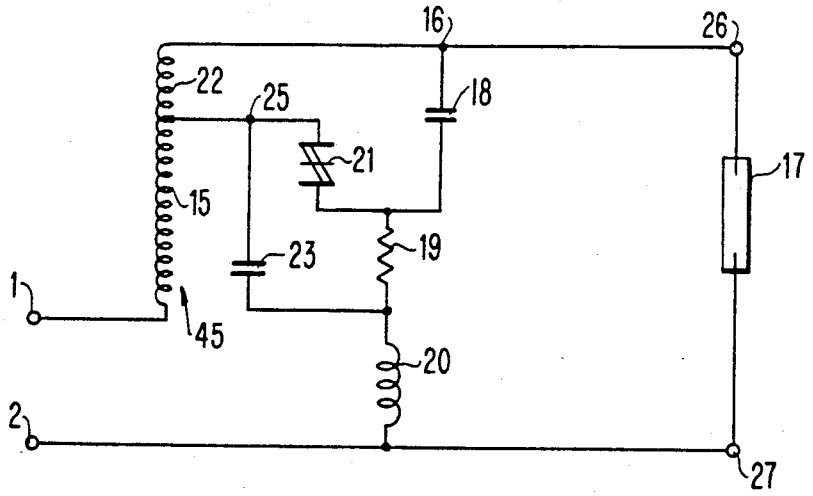
FIG. 3 is an alternate to the circuit of FIG. 2.
Figure 4:
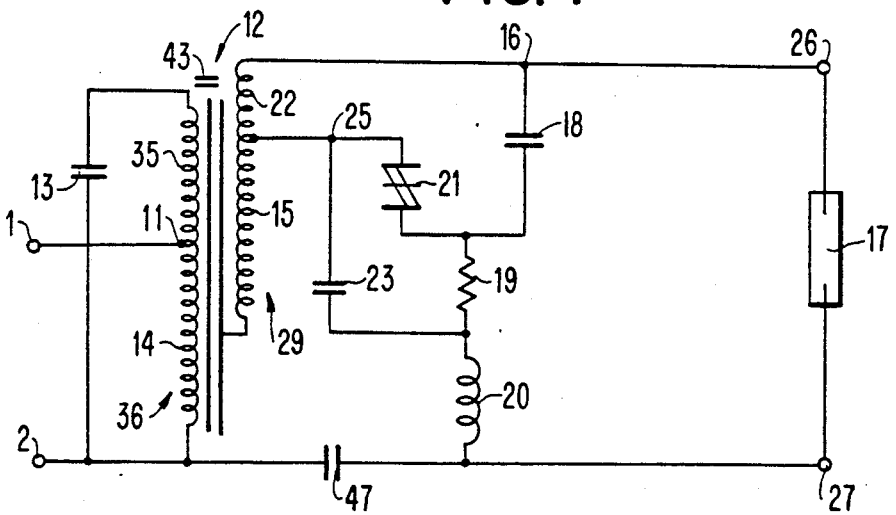
FIGS. 4 and 5 are additional alternates to the circuit of FIG. 2.
Figure 5:
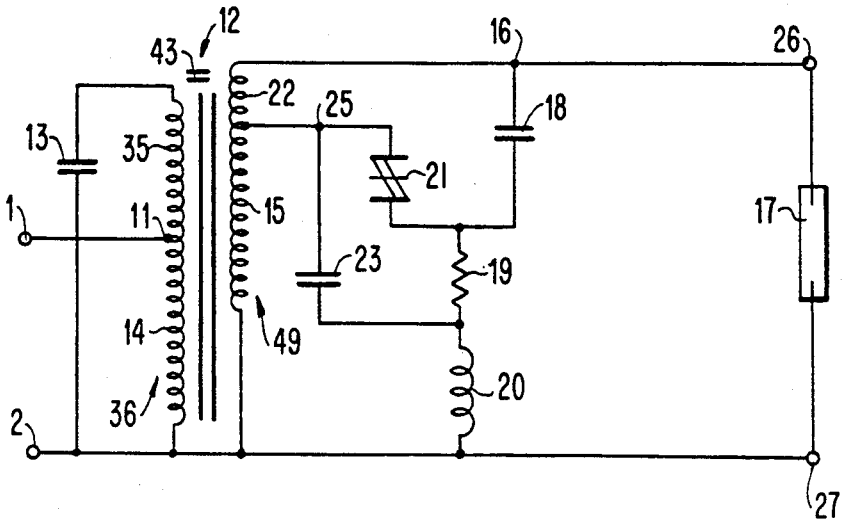

It should be apparent that modifications of the disclosed invention will be evident to those skilled in the art. For example, an autotransformer is not necessary for the operation of lamp 17. A simple reactor serially connected to the lamp could also be employed, such as shown as 45 in FIG. 3. Moreover, the autotransformer could be changed from lagging operation to leading by connecting capacitor 47 between the transformer and inductor 20 as shown in FIG. 4. Also, the autotransformer could have an isolated secondary as shown as 49 in FIG. 5. For this reason, the arrangement described herein is for illustrative purposes and is not to be considered restrictive.

WHAT IS CLAIMED IS:

1. Apparatus for igniting and operating a high pressure discharge lamp comprising:

a pair of input terminals for connection to a source of low frequency AC supply voltage, a pair of output terminals for connection to the electrodes of the high pressure discharge lamp, inductance means having a winding coupled to at least one of said output terminals, a first capacitor, an impedance means including a resistor and an inductor in a first series circuit, means connecting said first capacitor and said impedance means in a second series circuit, additional means coupling said second series circuit to said input terminals by way of a part of said inductance means, a voltage sensitive switching element coupled to said first capacitor and to said inductance means and operable to at least partly discharge said first capacitor when the voltage across said first capacitor equals a predetermined breakdown voltage of the switching element, a second capacitor, and further means coupling said second capacitor to said inductance means and to a junction point between said resistor and said inductor of said impedance means.

2. Apparatus as claimed in claim 1, wherein said first capacitor and said switching element are connected in series across said winding of said inductance means.

3. Apparatus as claimed in claim 2, wherein said second capacitor is connected in parallel across said voltage sensitive switching element and said resistor of said impedance means.

4. Apparatus as claimed in claim 3, wherein said inductance means comprises an autotransformer with a secondary having first and second legs.

5. Apparatus as claimed in claim 4, wherein said inductance winding connected in parallel with said first capacitor and said switching element is the first leg of the secondary of said autotransformer.

6. Apparatus as claimed in claim 5, wherein one end of said second capacitor and one end of said voltage sensitive switching means is connected to a junction point between the first leg and the second leg of the secondary of said autotransformer.

7. An ignitor for a gas discharge lamp comprising first and second terminals for connection to a transformer winding and a third terminal for connection to a lamp electrode, a first capacitor and an impedance means including a resistor with two end connections and an inductor in a first series circuit connected to one end of said resistor, said first capacitor and said impedance means connected in the series circuit between said first and third terminals, a bidirectional voltage sensitive semiconductor switching element having a predetermined voltage threshold level connected between the second terminal and a terminal of the first capacitor remote from said first terminal, and a second capacitor connected in parallel across said voltage sensitive switching element and said resistor and connected directly to said one end of said resistor.

8. An ignitor as claimed in claim 7, wherein said first capacitor and said switching element are connected in series across said transformer winding.

9. An ignitor as claimed in claim 8, wherein said transformer comprises an autotransformer with a secondary having first and second legs.

10. An ignitor as claimed in claim 4, wherein said transformer winding connected in parallel with said first capacitor and said switching element is the first leg of the secondary of said autotransformer.

11. An ignitor as claimed in claim 10, wherein one end of said second capacitor and one end of said voltage sensitive switching means is connected to a junction point between the first leg and the second leg of the secondary of said autotransformer.

12. Apparatus as claimed in claim 3, wherein said inductance means is a simple reactor.

13. Apparatus as claimed in claim 3, wherein a third capacitor is connected between said inductance means and said inductor.

14. Apparatus as claimed in claim 4, wherein said autotransformer has an isolated secondary.

* * * * *